US007147491B1

(12) United States Patent
Poilasne

(10) Patent No.: US 7,147,491 B1
(45) Date of Patent: Dec. 12, 2006

(54) NON-CONTINUOUS COUNTERPOISE SHIELD

(75) Inventor: Gregory Poilasne, San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 11/134,656

(22) Filed: May 20, 2005

(51) Int. Cl.
*H01R 13/52* (2006.01)

(52) U.S. Cl. ..... 439/88

(58) Field of Classification Search ..... 439/620, 439/607, 608–610, 88, 89; 174/35 R; 343/700 MS, 343/702, 906, 787
See application file for complete search history.

(56) References Cited

U.S. PATENT DOCUMENTS 5,835,071 A * 11/1998 Phelps ..... 343/906
6,031,493 A * 2/2000 Tsuda et al. ..... 343/702
6,482,017 B1 * 11/2002 Van Doorn ..... 439/89
6,597,319 B1 * 7/2003 Meng et al. ..... 343/702
6,849,800 B1 2/2005 Mazurkiewicz
6,882,317 B1 * 4/2005 Koskiniemi et al. . 343/700 MS
6,903,687 B1 * 6/2005 Fink et al. ..... 343/700 MS
2006/0038630 A1 * 2/2006 Kawaguchi et al. ..... 333/12

* cited by examiner

*Primary Examiner*—Alexander Gilman

(57) ABSTRACT

A wiring connector is provided with counterpoise shielding. The connector comprises a shell and at least one pair of contacts, supported in the shell, for passing a signal and corresponding counterpoise. Each contact has an input interface, where it mates to either a wire bundle or a circuit board, and a mating connector interface, where it mates with another connector. The connector also comprises a radiation shield comprising ferrite particles embedded in a dielectric, overlying the contact pair. In one aspect, the shell includes a housing and a dielectric interposed between the contacts and the housing. Then, the radiation shield is embedded in the dielectric. In another aspect, the radiation shield is part of the housing.

3 Claims, 8 Drawing Sheets

NON-CONTINUOUS COUNTERPOISE SHIELD

BACKGROUND OF THE INVENTION

1. Field of the Invention

This invention generally relates to electromagnetic radiation shielding for electrical connectors and, more particularly, to a shield for controlling radiation associated with an electrical connector having a non-continuous counterpoise.

2. Description of the Related Art

As noted in U.S. Pat. No. 6,849,800, Mazurkiewicz, electromagnetic emissions are the unwanted byproduct of high-frequency electronic signals necessary, for example, to operate an electronic microprocessor, logic circuitry, or a radio frequency (RF) antenna. The resulting electromagnetic interference (EMI) is problematic when it interferes with licensed communications such as cellular telephones, nearby electrical circuits, and connected electrical equipment. This type of interference may also be known as radio-frequency interference (RFI).

To meet EMI regulations or otherwise control radiated emissions, electronic equipment may employ a combination of two approaches commonly referred to as "source suppression" and "containment." Source suppression attempts to design components and subsystems such that only essential signals are present at signal interconnections, and that all non-essential radio frequency (RF) energy is either not generated or attenuated before it leaves the component subsystem. Containment attempts conventionally include placing a barrier around the assembled components, subsystems, and interconnections, to retain unwanted electromagnetic energy within the boundaries of the product where it is harmlessly dissipated.

This latter approach, containment, is based on a principle first identified by Michael Faraday (1791-1867), that a perfectly conducting box completely enclosing a source of electromagnetic emissions prevents those emissions from leaving the boundaries of the box. This principle is employed in shielded cables as well as in conventional shielded enclosures. Conventional shielded enclosures are typically implemented as a metal box or cabinet that encloses the equipment. The metal box is commonly referred to as a metallic cage and is often supplemented with additional features in an attempt to prevent RF energy from escaping via the power cord and other interconnecting cables. For example, a product enclosure might consist of a plastic structure with a conductive coating on the surface. This approach is commonly implemented in, for example, cell phones. More commonly, the metal enclosure is implemented as a metal cage located inside the product enclosure. Since the EMI suppression necessary for the entire product or system requires that only a portion of the product be shielded, such metallic cages are commonly placed around selected components or subsystems.

There are numerous drawbacks to the use of such metallic cages primarily relating to the lack of shielding effectiveness. Electromagnetic energy often escapes the metallic cage at gaps between the metallic cage and the printed circuit board. Electrical gaskets and spring clips have been developed to minimize such leakage. Unfortunately, such approaches have only limited success at shielding while increasing the cost and complexity of the printed circuit board. In addition, leakage occurs because the cables and wires penetrating the metallic cage are not properly bonded or filtered as they exit the metallic cage. Further drawbacks of metallic cages include the added cost and weight to the printed circuit board assembly, as well as the limitations placed on the package design.

High frequency signals are communicated via cables, wiring, or across circuit boards based upon the principle that the signal-carrying medium can be formed into a (LC) transmission line. To that end, coaxial cables are formed from a center signal conductor and an outer coaxial ground. Signals can also be carried via a twisted-pair of wires. Microstrip circuit boards are made with a signal trace, coplanar grounds, and an underlying groundplane. However, when changing from one medium to another, a large voltage standing wave ratio (VSWR) may be created at the interface. For example, the interface between a coax cable and a microstrip circuit board may be a board mounted SMA connector that brings the signals off the board using vertical pins. At this interface, the ideal transmission line characteristics may be flawed, and the high VSWR may cause the conducted signal to radiate. Also, the contacts between push-on or screw/threaded coaxial connectors may have a high VSWR, resulting in unintentional radiation or other susceptibility to other radiation sources.

A conventional USB cable, such as might be used to connect a personal computer (PC) with a printer, provides another example of an unintended radiation problem. The ground signal from the computer is generally carried in the cable shield surrounding the signal wire. However, the cable/PC interface is a push-on connector that is likely to "leak" radiation. One common attempt to address this problem is the use of a ferrite bead or core. For example, a PC power cable may pass through one or more ferrite cores. The core mitigates against conducted radiation on the outside of the cable, but it does not address the problem at its source.

Other types of connections include a non-continuous counterpoise by necessity. For example, there may be no explicit ground (counterpoise) connection when a monopole antenna is connected to a coax cable or a microstrip board, as the radiated antenna energy may be designed to return to ground via other paths. Even for antennas having a counterpoise, a poor interface can become an unintended radiator. Alternately, a non-continuous counterpoise antenna connection becomes a likely entry place for unintended radiators and component noise that couple into a received RF signal, compromising receiver sensitivity.

The energy radiated from connector interfaces can be detrimental to proximate electrical circuits. In a wireless telephone for example, the energy radiated from an antenna connection can create "hotspots" on a telephone circuit board. A hotspot near a sensitive RF receiver may result in autojamming. Likewise, the jamming effect can result from energy being coupled into the circuit board from a cable-connected accessory. Alternately, a hotspot may result in component noise coupling with a signal that is transmitted by the antenna.

A large number of connectors designs exist based upon the above-mentioned metallic cage approach. The effectiveness of the designs is usually balanced against practical considerations such as size, complexity, cost, assembly time, and durability. Less attenuation has been paid to the shielding of antenna connectors, as the focus is usually centered on the ability of the antenna to effectively radiate. Some solutions involve shielding sensitive electrical circuits, as opposed to stopping the radiation at its source.

It would be advantageous if a simple, low-cost shield existed that effectively contained electromagnetic energy radiating from an electrical connector.

SUMMARY OF THE INVENTION

Accordingly, a wiring connector is provided with counterpoise shielding. The connector comprises at least one pair of contacts, supported in a shell, for passing a signal and corresponding counterpoise. Each contact has an input interface, where it mates to either a wire bundle or a circuit board, and a mating connector interface, where it mates with another connector. The connector also comprises a radiation shield comprising ferrite particles embedded in a dielectric, overlying the contact pair.

In one aspect, the shell includes a housing and a contact support dielectric interposed between the contacts and the housing. Then, the radiation shield is embedded in the contact support dielectric. In another aspect there is no support dielectric (the dielectric is air) and the radiation shield is part of the housing.

Also provided is an antenna connector with counterpoise shielding. The antenna connector comprises an antenna with an interface comprising a signal contact. A feed connector has signal contact connected to the antenna interface signal contact, and a counterpoise contact. A radiation shield, comprising ferrite particles embedded in a dielectric, overlies the feed connector contacts. The feed connector can be printed wiring board (PWB) microstrip trace or a coaxial connector. The antenna connector may further comprise a spring contact interposed between the printer circuit board microstrip trace signal contact and the antenna interface signal contact. For example, the radiation shield can be mounted on a bottom surface of the printed circuit board, adjacent the spring contact. Otherwise, the radiation shield may be part of a housing adjacent the spring contact.

Additional details of the above-described counterpoise-shielded connectors are provided below.

DETAILED DESCRIPTION

Figure 1:
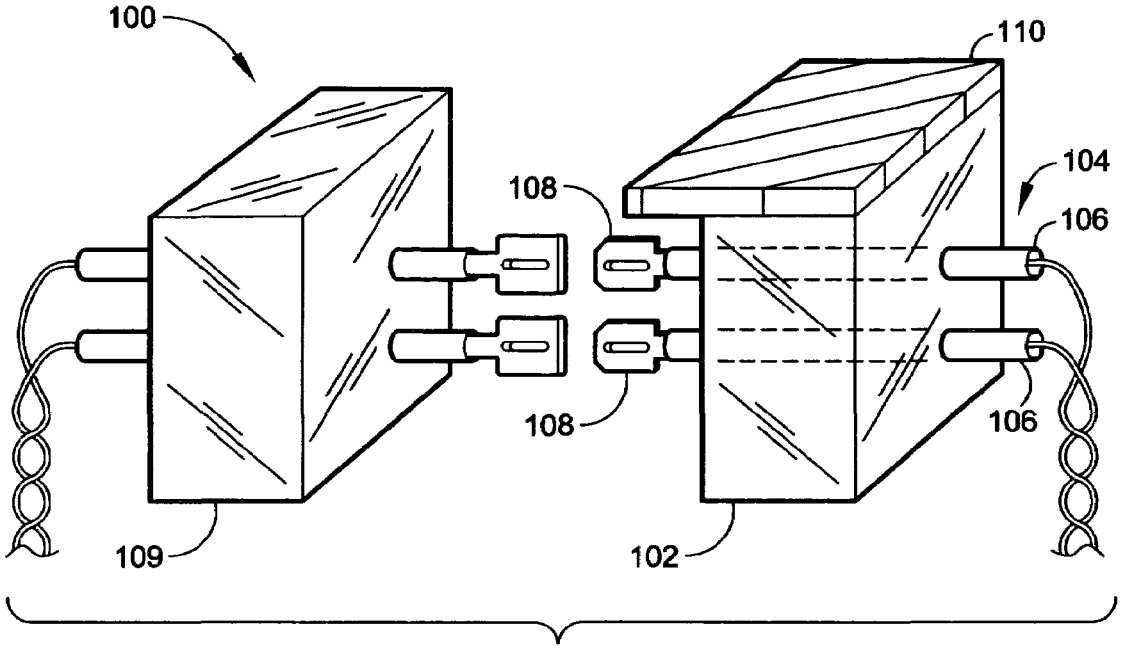
FIG. 1 is a schematic drawing of a wiring connector with counterpoise shielding.

FIG. 1 is a schematic drawing of a wiring connector with counterpoise shielding. The connector 100 comprises a shell 102 and at least one pair of contacts 104, supported in the shell 102, for passing a signal and corresponding counterpoise. The counterpoise to a signal is its relative ground or return path, which may be an AC ground, DC ground, or antenna radiation return path. Alternately, the signal and ground may be a differential signal pair. Each contact 104 has an input interface 106, where the connector interfaces with a wiring bundle (as shown), cable, or PWB, and a mating connector interface 108 for mating with another connector 109. A radiation shield 110, comprising ferrite particles embedded in a dielectric, overlies the contacts 104. Although the shield 110 is shown as being mounted on connector 100, in other aspects (not shown) the shield may be composed of elements of connector 100 cooperating with elements of connector 109.

Figure 2A:
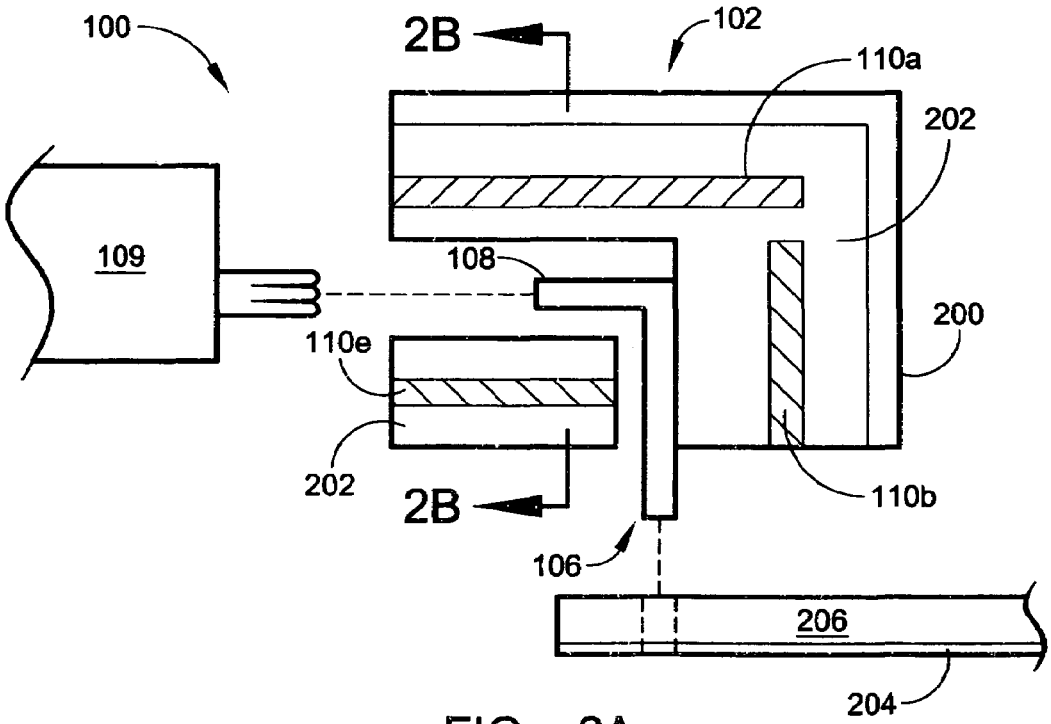
FIGS. 2A and 2B are partial cross-sectional views of a first variation of the connector of FIG. 1.
Figure 2B:
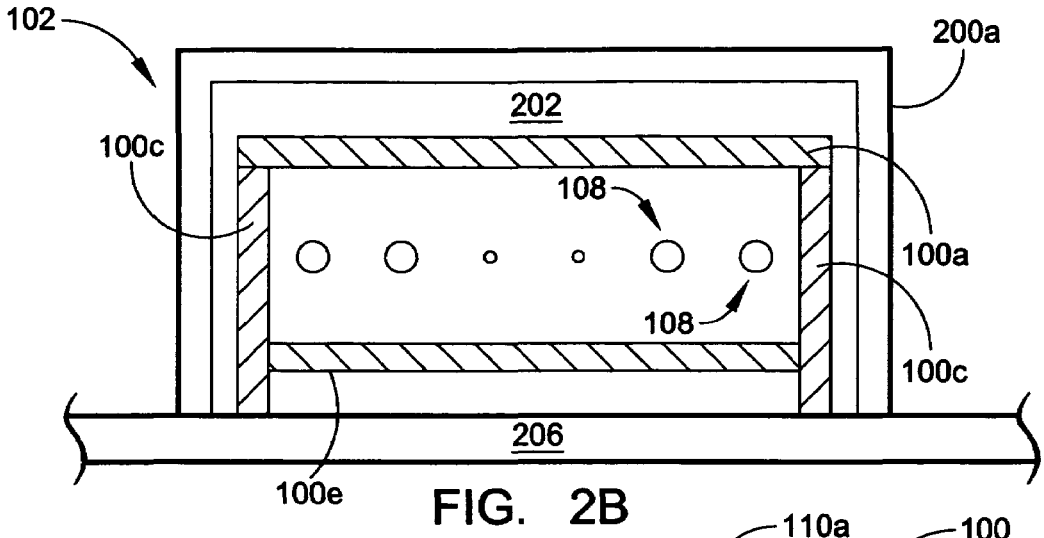

FIGS. 2A and 2B are partial cross-sectional views of a first variation of the connector of FIG. 1. A connector "shell" is intended to be generically applicable to a broad range of connector types. Generally, as used herein, a shell is intended to describe the mechanical support, covering, and interconnection means. Here, the connector 100 is shown as a "D" type PWB connector. There may be a ground (counterpoise) contact for every signal contact, or a ground contact that acts as a reference for a plurality of signal contacts. In one aspect, the shell 102 includes a housing 200 and a dielectric 202 interposed between the contacts 102 and the housing 200. The dielectric 202 may mechanically support the contacts 104, improve the transmission line characteristics of the connector, or both. The radiation shield 110, shown as cross-hatched, is embedded in the contact support dielectric 202. As shown, the radiation shield 110 has a top layer 110*a*, a back layer 110*b*, and a bottom layer 100*e* embedded in the dielectric 202. Top layer 110*a* and bottom layer 110*e* act as a shield in the connection with connector 109. Back layer 110*b* and bottom layer 110*e*, act as a shield in the connection to PWB 206. As shown in FIG. 2B, there may be side layer 110*c* so that the contacts are substantially enclosed by the shield 110 and the groundplane 204 of the mating PWB 206. In another aspect, the top, back, bottom, and side layers may be one continuous piece of shielding 110. In a different aspect, combinations of top layer 110*a*, back layer 110*b*, bottom layer 100*e*, and side layers 100*c* may be used.

Figure 3:
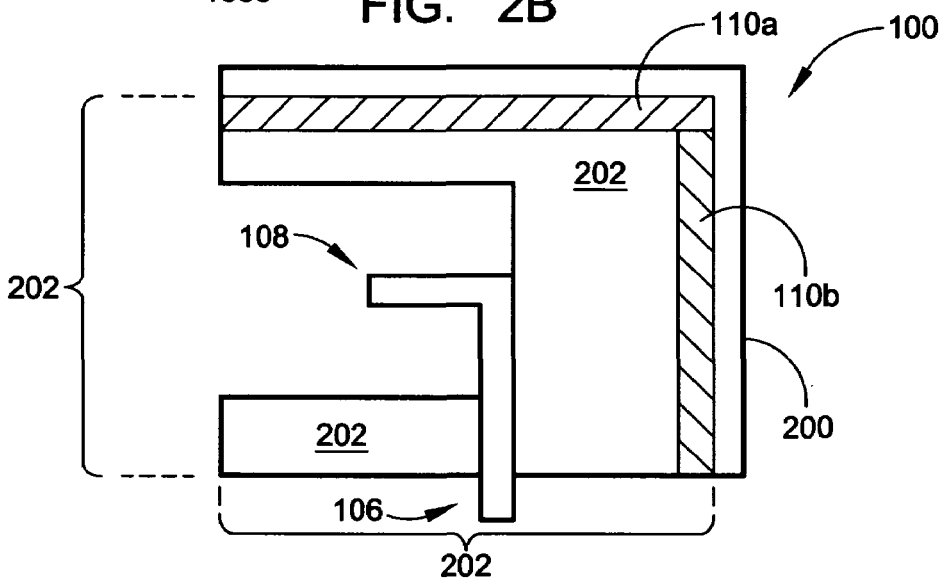
FIG. 3 is a partially cross-sectional view, showing another variation of the connector of FIG. 2A.

FIG. 3 is a partially cross-sectional view, showing another variation of the connector of FIG. 2A. In this view the shield top layer 110*a* and back layer 110*b* are formed on the outside surface 200 of the dielectric. As in FIG. 2A, the shield 110 may be formed as one continuous piece, or only particular surfaces may be shielded.

Figure 4A:
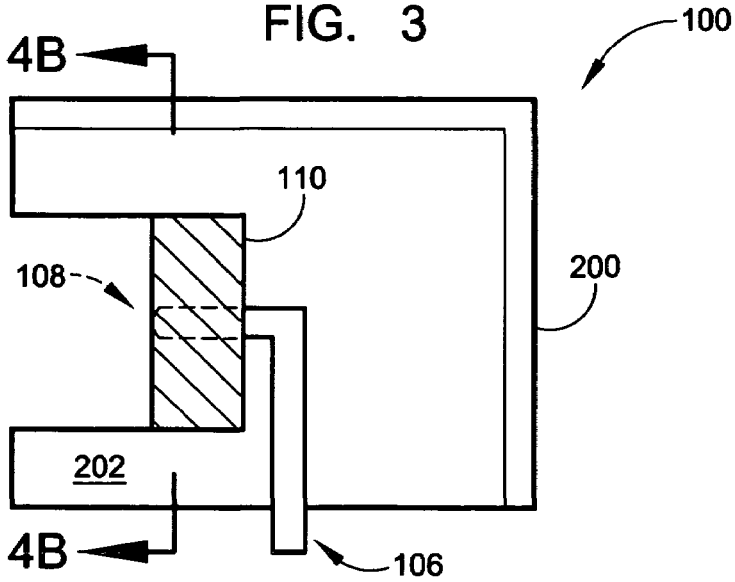
FIGS. 4A and 4B are partial cross-sectional and end views, respectively, of a second variation of the connector of FIG. 1.
Figure 4B:
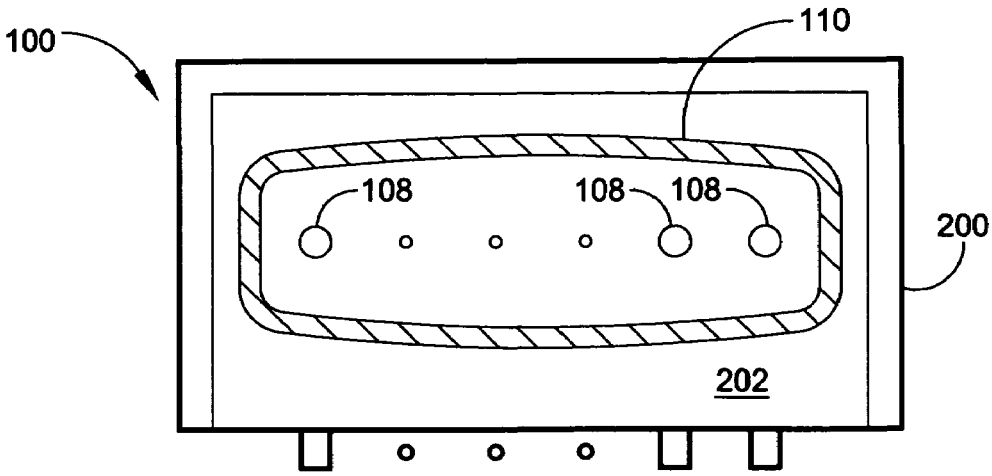

FIGS. 4A and 4B are partial cross-sectional and end views, respectively, of a second variation of the connector of FIG. 1. Here, the shield 110 is formed in the dielectric 202 as single ring 400 that surrounds all the contact interfaces 108. In an aspect not shown, the shield ring 400 surrounds contact interface 106, or extends uninterrupted from contact interface 106 to contact interface 108.

Figure 5:
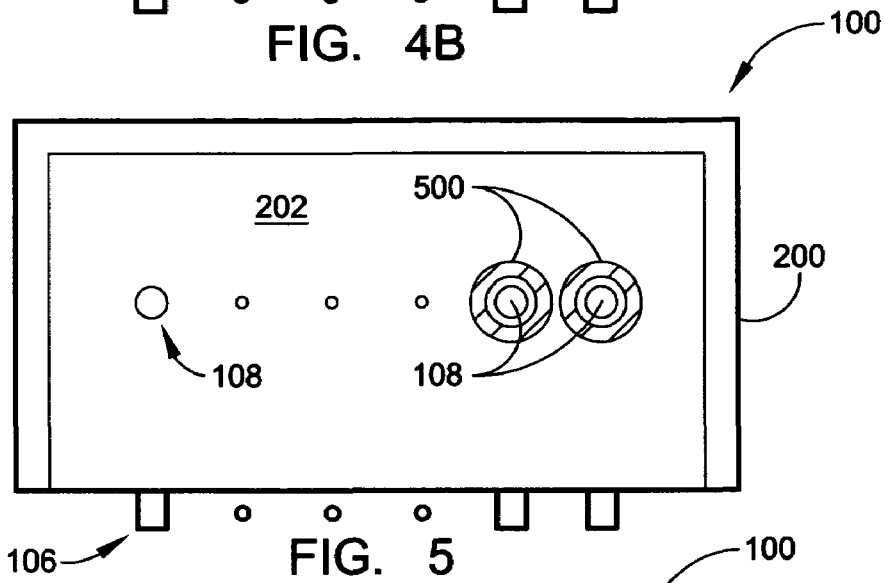
FIG. 5 is an end view showing another variation of the connector of FIG. 4*b*.

FIG. 5 is an end view showing another variation of the connector of FIG. 4*b*. In this aspect, shield rings 500 are formed around individual contact interfaces 108. For example, sensitive signal lines, grounds, or high current flow lines may be shielded. In an aspect not shown, each of the contact interfaces 108 is surrounded by a shield ring 500. In an aspect not shown, the shield rings 500 may extend to surround each individual contact interface 106, or extend uninterrupted from contact interface 106 to contact interface 108.

Figure 6:
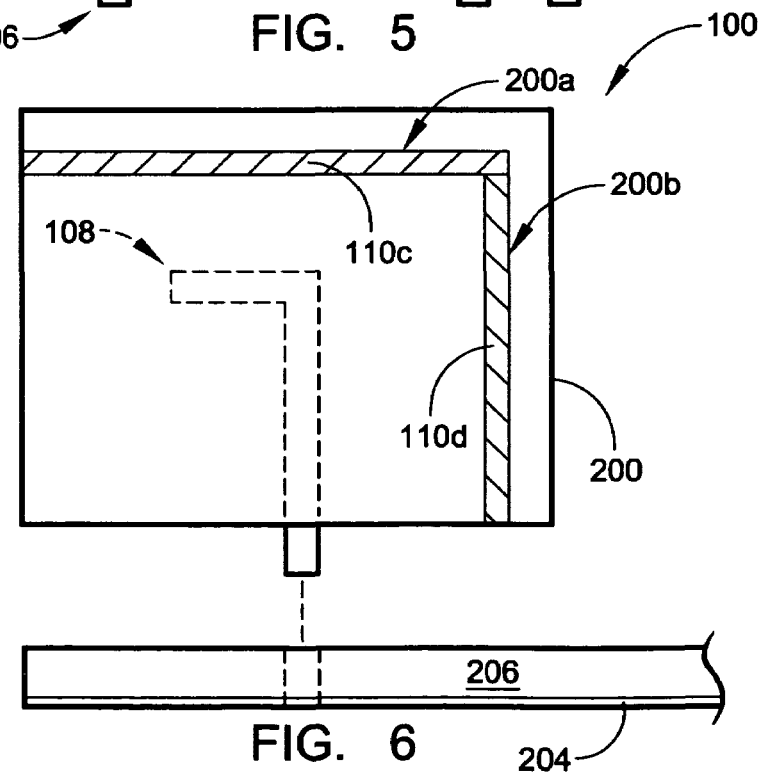
FIG. 6 is a partial cross-sectional view of a third variation of the connector of FIG. 1.

FIG. 6 is a partial cross-sectional view of a third variation of the connector of FIG. 1. Here, the shell includes a housing 200 at least partially overlying the contact interface 108. A dielectric 202 may, or may not (as shown) exist between the housing 200 and the contact interface 108. However in this aspect, the radiation shield 110 is part of the housing 200. For example, the dielectric 202 may be air or a conventional dielectric, or there may be no dielectric between the contacts and the housing.

As shown, the housing 200 includes a plurality of surfaces. Shown in cross-section are interior top surface 200*a* and interior back 200*b*. Likewise, the shielding 110 may be comprised of a plurality of radiation shield layers, each overlying a housing surface. Shown are shielding layers 110*c* and 110*d*, overlying surfaces 200*a* and 200*b*, respectively. In another aspect not shown, there may be housing sides and shield side layers (similar to the side shield layers in FIG. 2B), so that the contacts are substantially enclosed by the shield 110 and the groundplane 204 of the mating PWB 206. In another aspect, the shield top, back, bottom, and side layers may be one continuous piece of shielding 110. In a different aspect, combinations of top layer 110*c*, back layer 110*d*, bottom layer, and side layers may be used.

Figure 7:
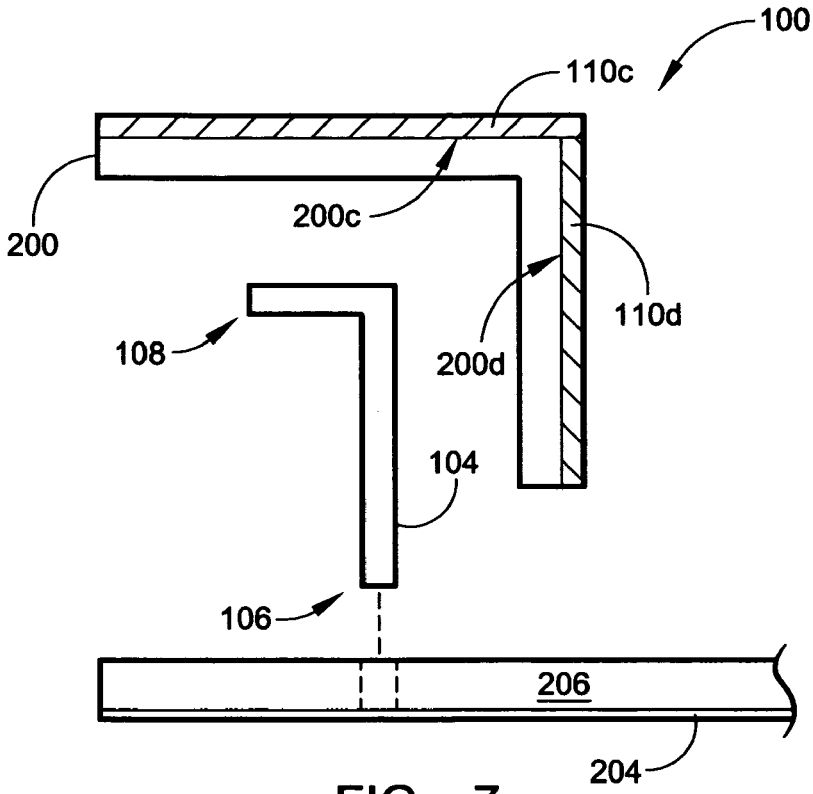
FIG. 7 is a partial cross-sectional view showing one variation of the connector of FIG. 6.

FIG. 7 is a partial cross-sectional view showing one variation of the connector of FIG. 6. In this aspect, the radiation shield 110 overlies the housing exterior surface. Shown in cross-section are exterior top surface 200*c* and exterior back surface 200*d*. Likewise, the shielding 110 may be comprised of a plurality of radiation shield layers, each overlying a housing surface. Shown are shielding layers 110*c* and 110*d*, overlying surfaces 200*c* and 200*d*, respectively. In another aspect not shown, there may be housing sides and shield side layers, or housing bottom and shield bottom layers so that the contacts 104 are substantially enclosed by the shield 110 and the groundplane 204 of the mating PWB 206. In another aspect, the shield top, back, bottom, and side layers may be one continuous piece of shielding 110. In a different aspect, combinations of top layer 110*c*, back layer 110*d*, bottom layer, and side layers may be used.

Figure 8:
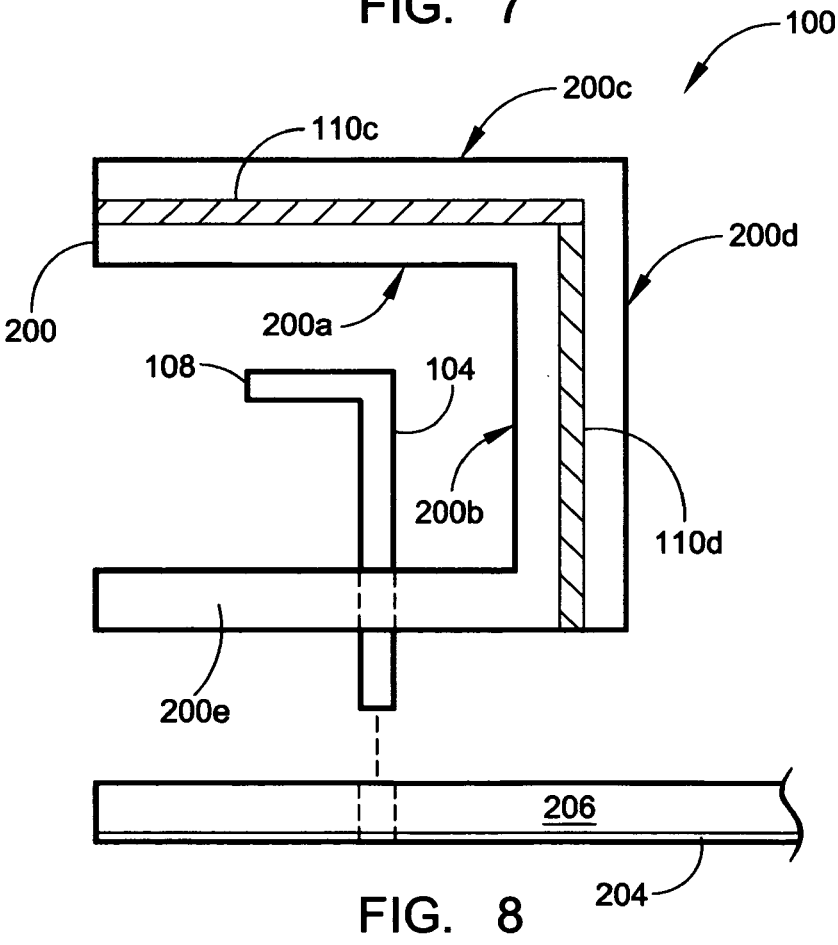
FIG. 8 is a partial cross-sectional view showing another variation of the connector of FIG. 6.

FIG. 8 is a partial cross-sectional view showing another variation of the connector of FIG. 6. In this aspect, the radiation shield 110 is embedded internal to the housing. Shown in cross-section are shielding layers 110*c* and 110*d* embedded between interior top surface 200*a* and exterior top surface 200*c*, and between interior back surface 200*b* and exterior back surface 200*d*. In another aspect not shown, there may be housing side and shield layer embedded in the housing side, or a housing bottom (200*e*) with a bottom shield layer (not shown), so that the contacts 104 are substantially enclosed by the shield 110 and the groundplane 204 of the mating PWB 206. In another aspect, the shield top, back, bottom, and side layers may be one continuous piece of shielding 110. In a different aspect, combinations of top layer 110*c*, back layer 110*d*, bottom layer, and side layers may be used.

Figure 16:
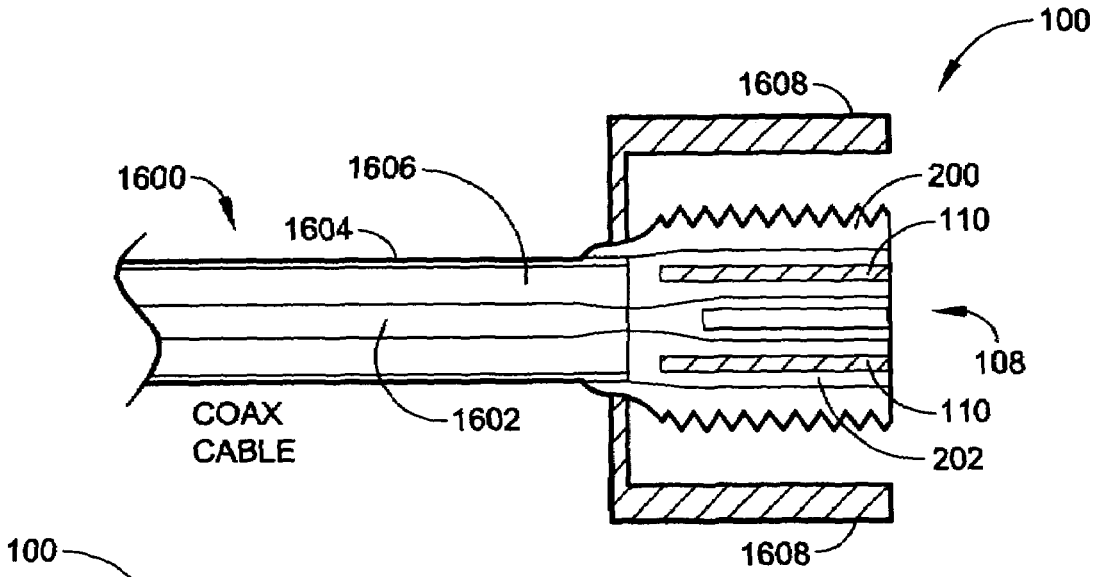
FIG. 16 is a partial cross-sectional view of coaxial connector variation of the connector of FIG. 1.

FIG. 16 is a partial cross-sectional view of coaxial connector variation of the connector of FIG. 1. A coaxial cable 1600 has a center conductor 1602 connected to the connector contact interface 108. The coax cable shield 1604 is connected to a metallic threaded section that acts as a connector housing 200. The coax cable 1600 includes a dielectric 1606 between the center conductor 1602 and the shield 1604. A dielectric 202 fills the area between the housing 202 and the contact interface 108. As shown, shielding 110 is embedded in the dielectric 202. Alternately but not shown, the shielding layer 110 may be on the interior surface of the dielectric adjacent the contact interface 108, or on the exterior surface of the dielectric adjacent the housing. In addition to the dielectric-embedded shield layer 110, a housing-external shield layer 1608 is shown overlying the connector housing 200.

Figure 17:
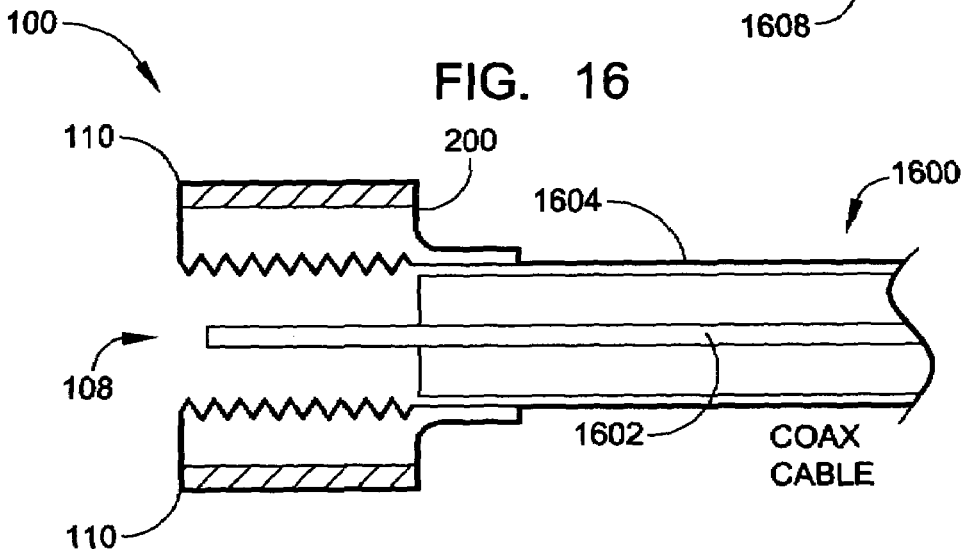
FIG. 17 is a partial cross-sectional view of a variation of the coaxial connector of FIG. 16.

FIG. 17 is a partial cross-sectional view of a variation of the coaxial connector of FIG. 16. Here, the radiation shield 100 lies on the external surface of the connector housing 200. As described in the "D" connector examples above, but not specifically shown here, the shield 110 may alternately be embedded in the housing, or on a housing internal surface.

To some extent, the ferrite particles that comprise the radiation shield may be any conductive material. However, there are conventional materials well known in the art to effectively absorb radiated energy. Neodymium-iron-boron (NdFeB) and samarium cobalt (SmCo) are two examples of such materials. The selection of a particular ferrite material may be dependent upon the frequency of radiation to be absorbed.

Likewise, the ferrite particles may be embedded in a number of well-known dielectric materials. Some examples of potential radiation shield dielectrics include nylon 6, nylon 12, and polyphenylene sulfide (PPS). However, other dielectric materials can also be used.

Further, ferrite particles embedded in a dielectric exist as prefabricated commercial products, such as the PE72, PE23, PE45, and PE44 materials made by the FDK Corporation. Similar materials are available from other manufacturers. In high volume commercial processes the above-described radiation shield may be formed in a 2-shot injection molding process, as part of the connector housing, support dielectric, or both.

Figure 9:
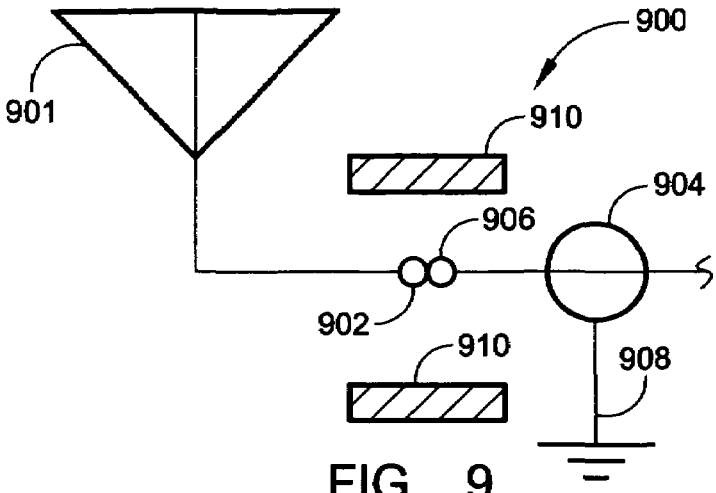
FIG. 9 is a schematic diagram of an antenna connector with counterpoise shielding.

FIG. 9 is a schematic diagram of an antenna connector with counterpoise shielding. The antenna connector 900 comprises an antenna 901 with an interface comprising a signal contact 902. A feed connector 904 has a signal contact 906 connected to the antenna interface signal contact 902, and a counterpoise contact 908. As explained below, the feed connector is typically a coaxial cable or microstrip transmission line on a PWB. A radiation shield 910 comprising ferrite particles embedded in a dielectric, overlies the feed connector contacts 906 and 906.

Figure 10:
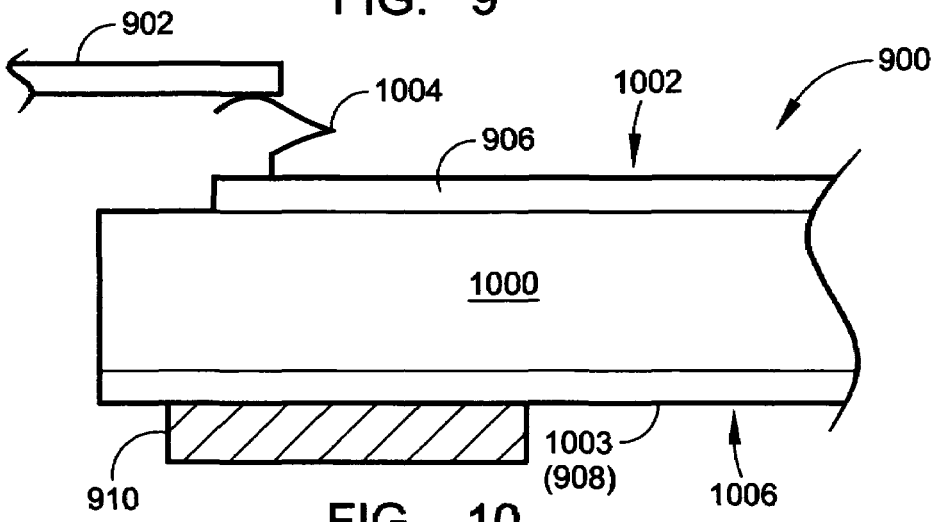
FIG. 10 is a partial cross-sectional view of a first variation of the antenna connector of FIG. 9.

FIG. 10 is a partial cross-sectional view of a first variation of the antenna connector of FIG. 9. Here, the feed connector signal contact 906 is a microstrip trace on a printed wiring board 1000 top surface 1002. The feed connector counterpoise 908 is the printed wiring board groundplanes 1003. Note, although the groundplane 1003 is depicted as on the PWB bottom surface 1006, typically there are grounds (not shown) coplanar with the signal contact trace 906. The antenna connector 900 further comprises a spring contact 1004 interposed between the printer circuit board microstrip trace signal contact 906 and the antenna interface signal contact 902. The spring contact is merely an example of one conventional antenna interface type. The VSWR at the spring contact 1004 is likely to be high, so that energy is unintentionally radiated. Alternately but not shown, the feed connector signal contact may be the center conductor of a coaxial cable.

The antenna 901 is a monopole design, where the monopole counterpoise is the grounds associated with connected circuit boards and chassis (not shown). As shown, the radiation shield 910 is mounted on a bottom surface 1006 of the printed circuit board 1000, adjacent the spring contact 1004. Advantageously, the radiation shield 910 can be mounted overlying the groundplane or signal traces on the PWB bottom surface. Alternately but not shown, the radiation shield can be placed over traces and components on the PWB top surface 1002, to avert the creation of hotspots.

Figure 11A:
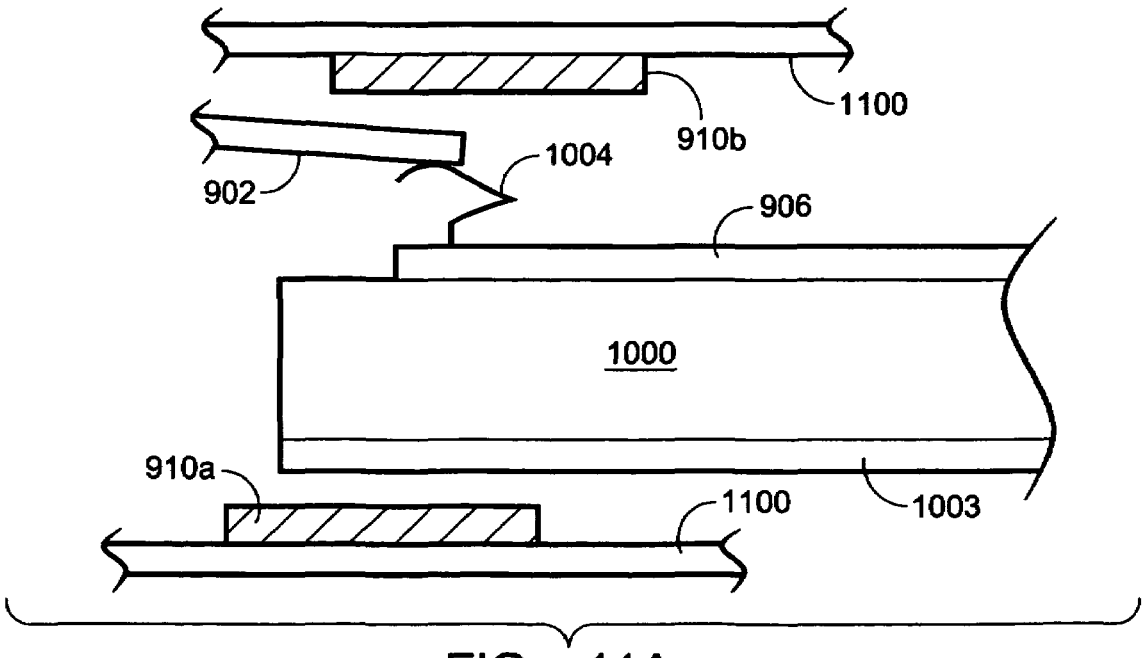
FIGS. 11A and 11B are orthogonal cross-sectional views showing a variation of the antenna connector of FIG. 10.
Figure 11B:
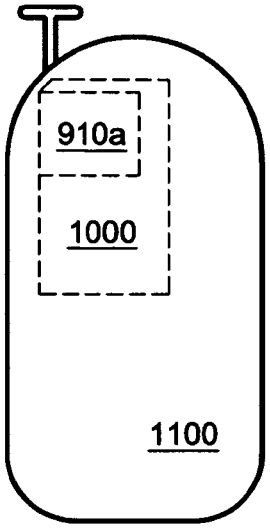

FIGS. 11A and 11B are orthogonal cross-sectional views showing a variation of the antenna connector of FIG. 10. A housing or chassis 1100 at least partially covers the spring contact 1004. For example, the housing 1100 can be the case of a cellular telephone. The radiation shield 910*a* is part of the housing 1100, adjacent the spring contact 1004. Although shown on the internal surface of the housing 1100, the shield 910*a* can alternately be formed on an exterior surface (not shown) or embedded in the housing between interior and exterior surfaces (not shown). In another aspect, a second shield 910*b* can be attached to the housing 1100 adjacent the spring contact 1004, so that emissions are absorbed on both sides of the housing. In another aspect, shield sections can be placed on the housing sides (not shown), so that shielding substantially surrounds the spring contact.

Figure 12:
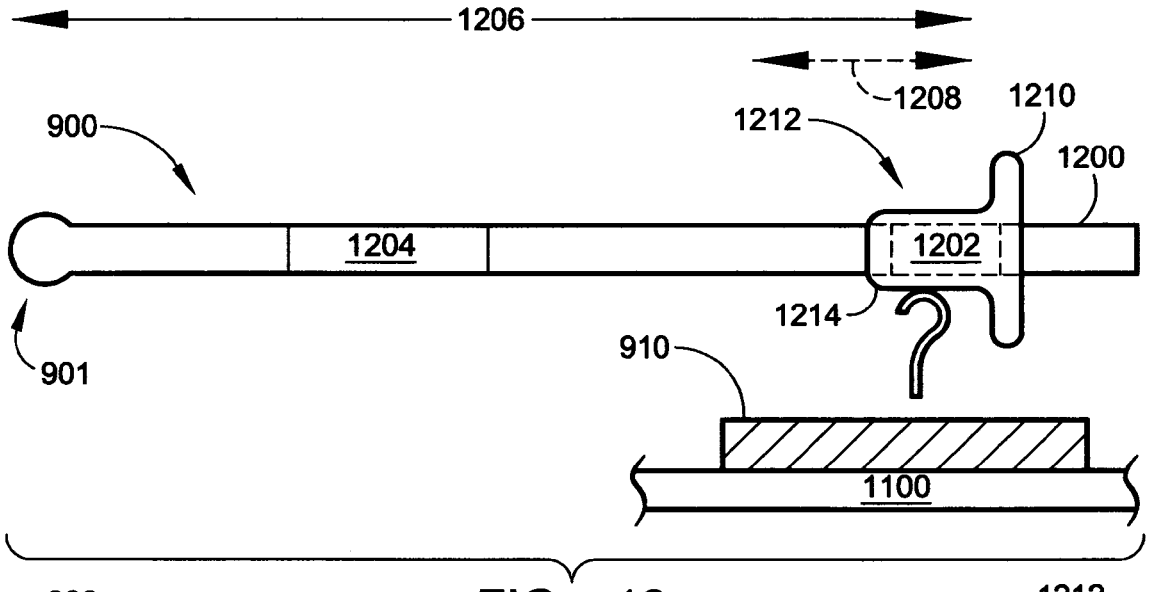
FIG. 12 is a partial cross-sectional view of a second variation of the antenna connector of FIG. 9.

FIG. 12 is a cross-sectional view of a second variation of the antenna connector of FIG. 9. The antenna 901 comprises a telescoping member 1200 with a first signal contact 1202 and a second contact 1204. The antenna 901 has a first electrical length 1206 in response to connecting the first signal contact 1202, and a second electrical length 1208 (shown in phantom) in response to connecting the second signal contact 1204. A collar 1210 has an aperture 1212 (in phantom) to slideably engage the telescoping member 1200 first and second signal contacts 1202/1204. A collar flange 1214 engages the spring contact 1004. A housing 1100 at least partially covers the spring contact. The radiation shield 910 is part of the housing 1100, adjacent the spring contact 1004. As shown, the shielding overlies the housing interior surface. Although not shown in this figure, radiation shields may be formed on more than one housing surface as described in the explanation of FIGS. 11A and 11B.

Figure 13:
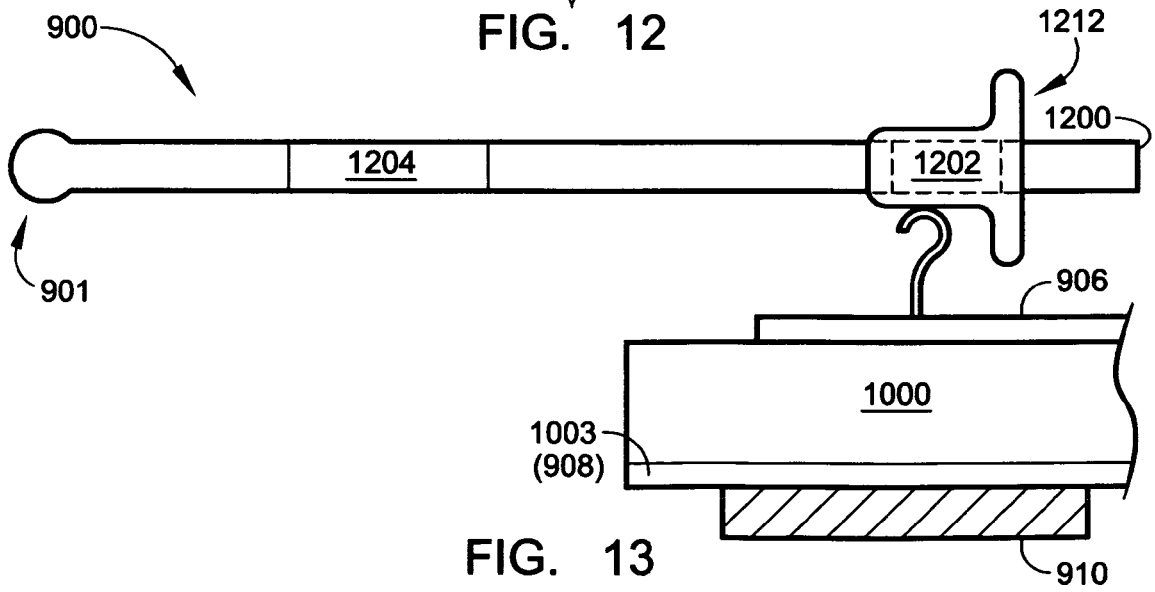
FIG. 13 is a partial cross-sectional view of a variation of the antenna connector of FIG. 12.

FIG. 13 is a partial cross-sectional view of a variation of the antenna connector of FIG. 12. Here, feed connector signal contact 906 is a printed wiring board 1000 top surface 1002 microstrip trace, and the feed connector counterpoise 908 is a printed wiring board groundplane 1003. Spring contact 1004 is interposed between the collar 1210 and the signal contact 906. The radiation shield 910 is mounted on a bottom surface 1006 of the printed circuit board 1000, adjacent the spring contact.

Figure 14A:
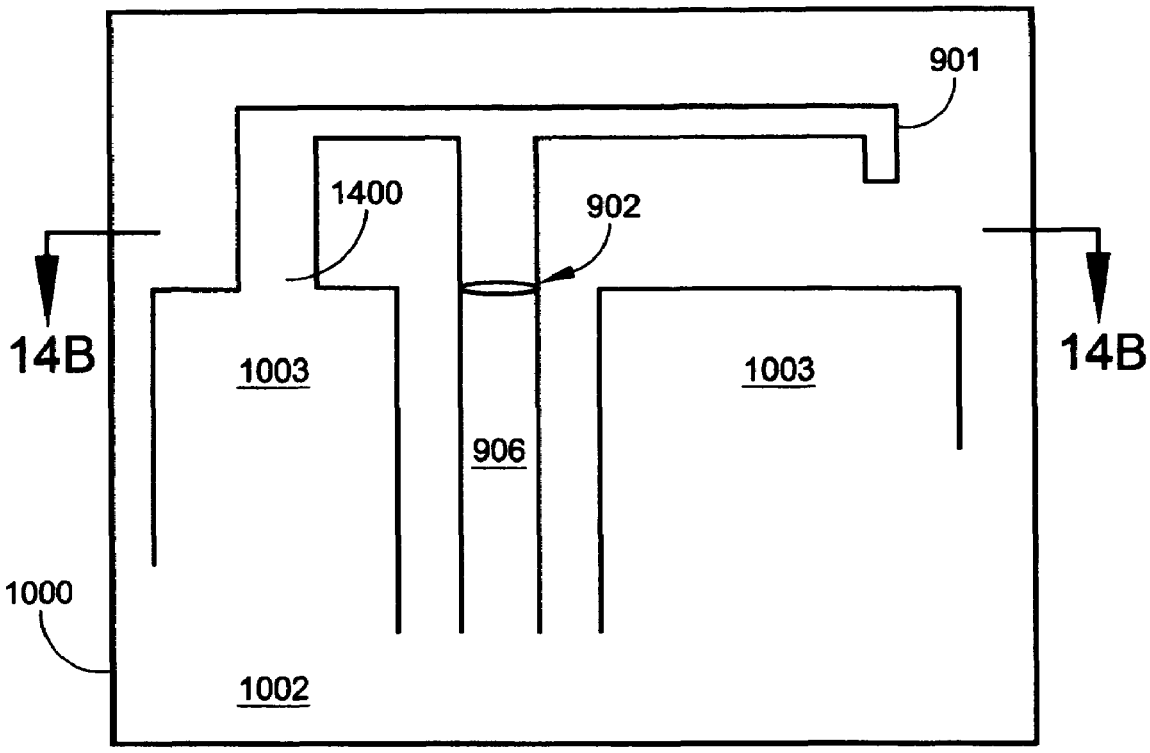
FIGS. 14A and 14B are partial cross-sectional and plan views, respectively, of a third variation of the antenna connector of FIG. 9.
Figure 14B:
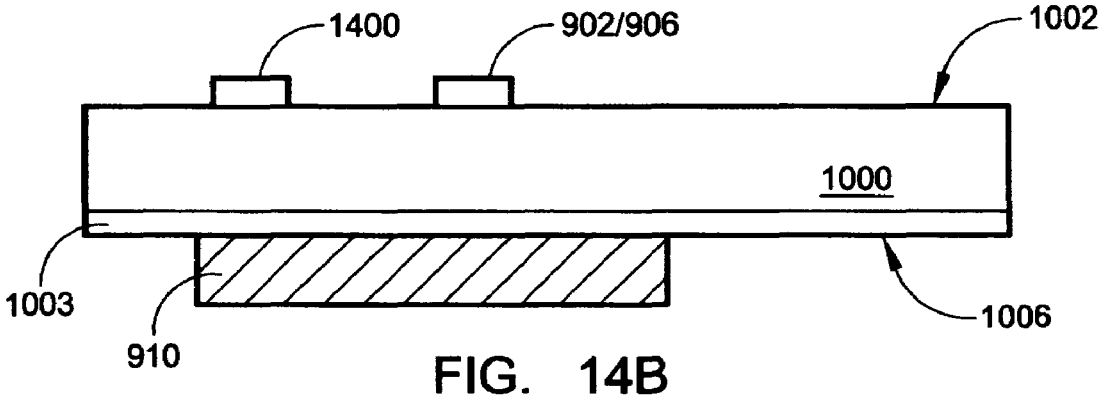

FIGS. 14A and 14B are partial cross-sectional and plan views, respectively, of a third variation of the antenna connector of FIG. 9. In this aspect, the feed connector signal contact 906 is the microstrip trace of a printed wiring board 1000 top surface 1002. The feed connector counterpoise 908 is the printed wiring board groundplane 1003. The antenna 901 is a planar inverted-F antenna (PIFA) with a signal contact element 902 connected to the printed wiring board signal trace 906 and a counterpoise contact element 1400 connected to the printed wiring board groundplane 1003. The radiation shield 910 is mounted on a bottom surface 1006 of the printed circuit board 1000, adjacent the PIFA signal contact 906 and counterpoise contact 1400.

Figure 15:
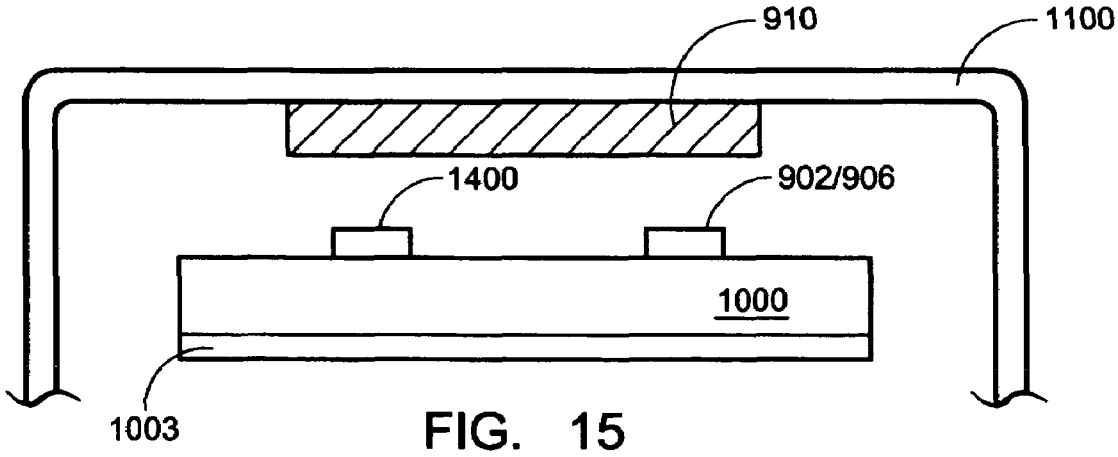
FIG. 15 is a partial cross-sectional view of a variation of the antenna connector of FIG. 14.

FIG. 15 is a partial cross-sectional view of a variation of the antenna connector of FIG. 14. In this aspect, a housing 1100 at least partially covers the PIFA signal contact 906 and counterpoise contact 1400. The radiation shield 910 is part of the housing 1100, adjacent the PIFA signal and counterpoise contacts 906/1400. Variations of housing placements are detailed in FIGS. 11A and 11B.

Figure 18:
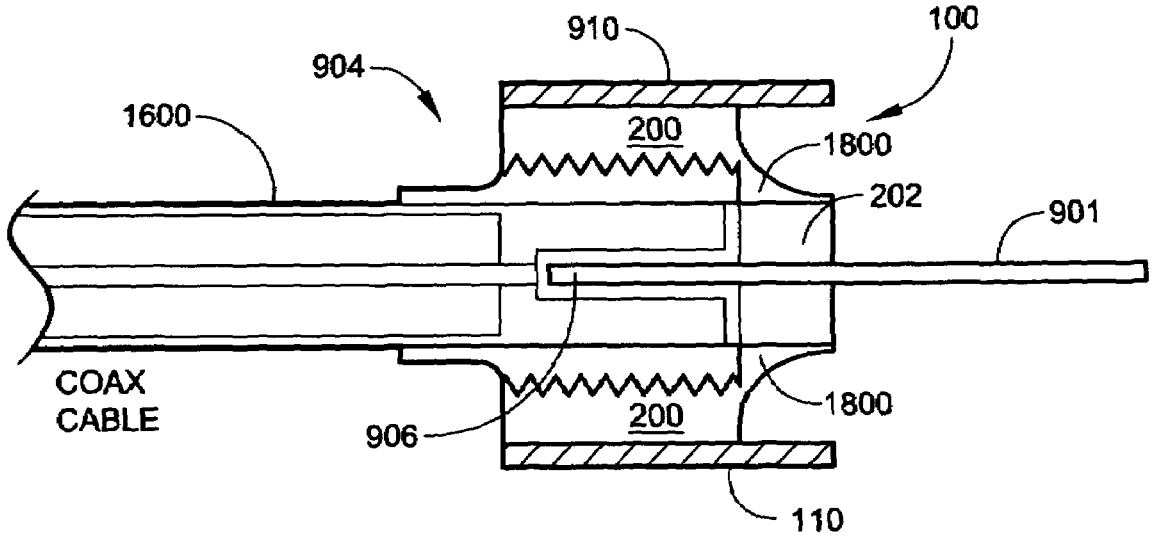
FIG. 18 is a partial cross-sectional view of coaxial connector, with a radiation shield, connected to a monopole antenna.

FIG. 18 is a partial cross-sectional view of coaxial connector, with a radiation shield, connected to a monopole antenna. Here, a conventional female coax feed connector 904 is shown interfaced with coaxial cable 1600. Radiation shield 910 is mounted external to the housing 200 of the connector 100, which in turn overlies the antenna signal contact 906. In this variation the radiation shields 910 extend to cover the truncated ground 1800 overlying dielectric 202 of connector 100. However as described above, other shielding variations are possible.

As mentioned above, some exemplary ferrite particles neodymium-iron-boron (NdFeB) and samarium cobalt (SmCo), while exemplary radiation shield dielectric materials include nylon 6, nylon 12, and polyphenylene sulfide (PPS). Again, prefabricated sheets of material could be fashioned into use as radiation shields. The PE72, PE23, PE45, and PE44 materials made by the FDK Corporation are a potential material.

Connectors made with counterpoise shielding have been provided. Some examples of materials and applications have been given to illustrate the invention. For example, the invention has application to liquid crystal display (LCD) interfaces. Examples of particular radiation shield shapes and placements have also been provided. However, the invention is not limited to merely these examples. Other variations and embodiments of the invention will occur to those skilled in the art.

I claim:

1. An antenna connector with counterpoise shielding, the antenna connector comprising:

an antenna with an interface comprising a signal contact;

a feed connector having a signal contact comprising a printed wiring board top surface microstrip trace, a counterpoise comprising a printed wiring board groundplane, and a counterpoise contact, the feed connector signal contact connected to the antenna interface signal contact;

a spring contact interposed between the feed connector signal contact and the antenna interface signal contact; and a radiation shield comprising ferrite particles embedded in a dielectric, overlying the feed connector contacts, the radiation shield mounted on a bottom surface of the printed circuit board, adjacent the spring contact.

2. An antenna connector with counterpoise shielding, the antenna connector comprising:

a planar inverted-F antenna (PIFA) antenna with an interface comprising a signal contact element and a counterpoise contact element;

a feed connector having a signal contact comprising a printed wiring board top surface microstrip trace, a counterpoise comprising a printed wiring board groundplane, and a counterpoise contact, the feed connector signal contact connected to the antenna interface signal contact element, the feed connector counterpoise connected to the antenna interface counterpoise contact element; and a radiation shield comprising ferrite particles embedded in a dielectric, overlying the feed connector contacts, wherein the radiation shield is mounted on a bottom surface of the printed circuit board, adjacent the PIFA signal and counterpoise contact elements.

3. An antenna connector with counterpoise shielding, the antenna connector comprising:

an antenna with an interface comprising:

a telescoping member with a first signal contact and a second contact, and wherein the antenna has a first electrical length in response to connecting the first signal contact, and a second electrical length in response to connecting the second signal contact;

a collar having an aperture to slideably engage the telescoping member first and second signal contacts, and a flange;

a feed connector having a signal contact comprising a printed wiring board top surface microstrip trace, a counterpoise comprising a printed wiring board groundplane, and a counterpoise contact, the feed connector signal contact connected to the antenna interface flange;

a spring contact interposed between the feed connector signal contact and the antenna interface flange to engage the antenna interface flange; and a radiation shield comprising ferrite particles embedded in a dielectric, overlying the feed connector contacts, wherein the radiation shield is mounted on a bottom surface of the printed circuit board, adjacent the spring contact.

* * * * *